US005909805A

United States Patent [19]

Neely

[11] Patent Number: 5,909,805

[45] Date of Patent: Jun. 8, 1999

[54] LABEL ASSEMBLY FOR PACKAGE SLEEVE ACCOMMODATING A STORAGE MEDIA DISC AND METHOD FOR SEALING A PACKAGE SLEEVE

[75] Inventor: Phillip K. Neely, Terre Haute, Ind.

[73] Assignees: Sony Corporation, Tokyo, Japan; Digital Audio Disc Corporation, Terre Haute, Ind.

[21] Appl. No.: 08/996,494

[22] Filed: Dec. 23, 1997

Related U.S. Application Data

[63] Continuation-in-part of application No. 08/729,773, Oct. 8, 1996, Pat. No. 5,722,538, which is a continuation of application No. 08/407,717, Mar. 21, 1995, abandoned, which is a continuation-in-part of application No. 08/261,681, Jun. 17, 1994, abandoned.

[51] Int. Cl.[6] ..... B65D 85/57

[52] U.S. Cl. ..... 206/308.1; 40/638; 206/459.5

[58] Field of Search ..... 206/308.1, 308.3, 206/459.5, 831; 40/312, 630, 638; 156/277, 441.5, 442.1; 229/307, 313, 123.2; 283/79, 81, 100, 101, 103, 105

[56] References Cited

U.S. PATENT DOCUMENTS

| | | | |
|---|---|---|---|
| 1,464,378 | 8/1923 | Wilburger | 229/72 |
| 1,872,636 | 10/1932 | Ames | 229/123.2 |
| 3,337,119 | 8/1967 | Bowers et al. | 206/312 |
| 3,426,960 | 2/1969 | Shore | 206/312 |
| 3,717,297 | 2/1973 | Perry | 229/72 |
| 3,767,038 | 10/1973 | Channing et al. | 229/74 |
| 4,771,891 | 9/1988 | Sorensen et al. | 206/459.5 |
| 4,905,831 | 3/1990 | Bagdis et al. | 206/308.3 |
| 5,071,167 | 12/1991 | O'Brien | 283/81 |
| 5,118,375 | 6/1992 | Malachowski et al. | 156/442.1 |
| 5,188,229 | 2/1993 | Bernstein | 206/308.1 |
| 5,217,307 | 6/1993 | McClintock | 206/831 |
| 5,318,222 | 6/1994 | Bartlett | 229/313 |
| 5,333,728 | 8/1994 | O'Brien et al. | 206/312 |
| 5,428,032 | 6/1995 | Sheu et al. | 206/308.1 |

*Primary Examiner*—Jim Foster
*Attorney, Agent, or Firm*—Frommer Lawrence & Haug, LLP.; William S. Frommer

[57] ABSTRACT

A label assembly for a package sleeve accommodating a storage media disc in a sleeve cavity thereof. The label assembly includes a removable tear strip assembly having a pair of removable tear strips with one of the tear strips covering the sleeve cavity such that when the tear strips are detached along perforation lines, the disc can be removed from the sleeve cavity. The tear strips also have a deadened adhesive backing so that no adhesive can contact the disc. In this label assembly, a first information section and a second information section are positioned on opposite sides of the tear strip assembly. The first information section includes mailing identification information for identifying mailing information regarding the package sleeve and the second information section includes disc identification information providing product identification information regarding the storage media disc accommodated within the package sleeve. This label assembly also providing for evidence of tampering.

47 Claims, 7 Drawing Sheets

FIG. 1
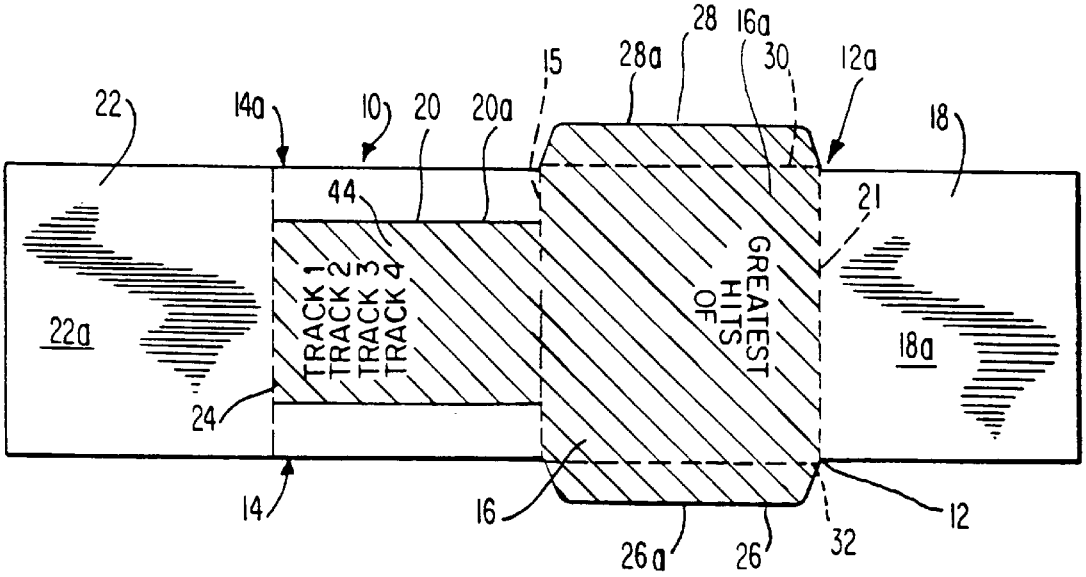
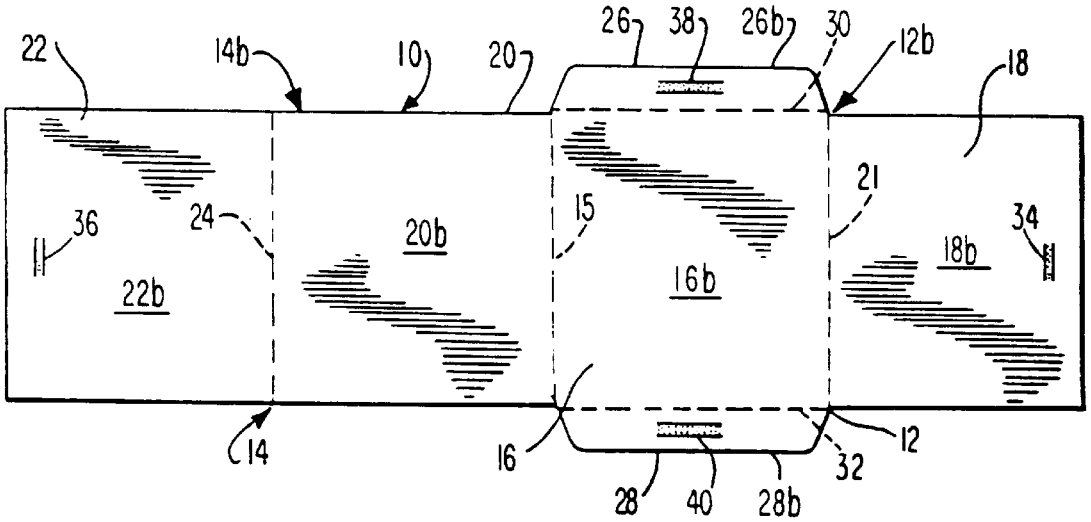
FIG. 2

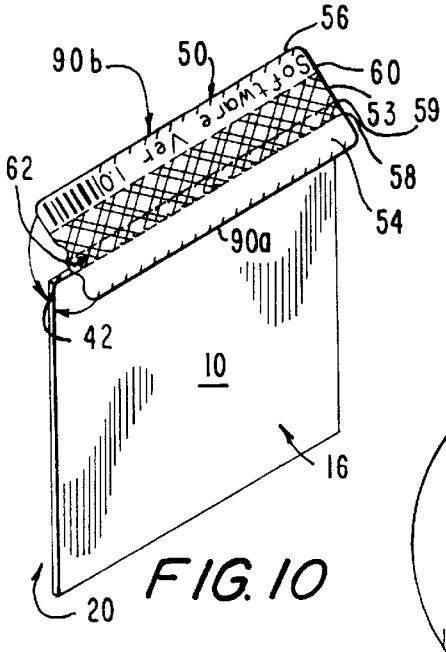
FIG. 10
FIG. 11
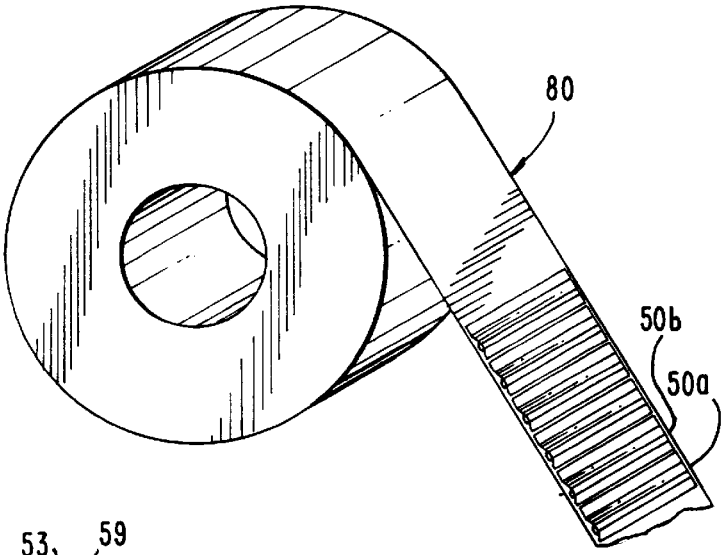
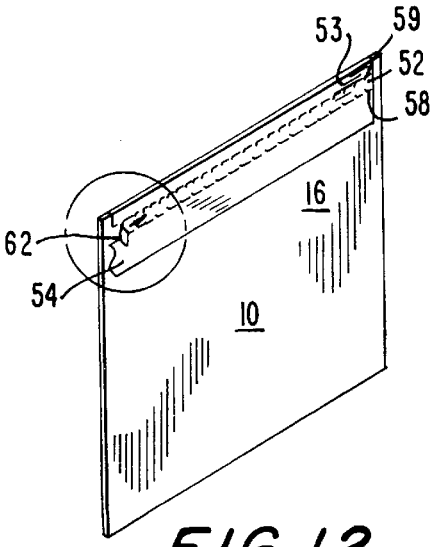
FIG. 12
FIG. 13
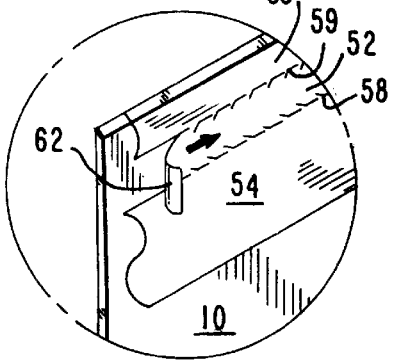

LABEL ASSEMBLY FOR PACKAGE SLEEVE ACCOMMODATING A STORAGE MEDIA DISC AND METHOD FOR SEALING A PACKAGE SLEEVE

CROSS-REFERENCE TO RELATED APPLICATIONS

This application is a continuation-in-part application of U.S. patent application Ser. No. 08/729,773 filed Oct. 8, 1996, entitled LABEL ASSEMBLY FOR PACKAGE SLEEVE ACCOMMODATING A STORAGE MEDIA DISC AND METHOD FOR SEALING A PACKAGE SLEEVE, now U.S. Pat. No. 5,722,538 which is a continuation of U.S. patent application Ser. No. 08/407,717, filed Mar. 21, 1995, now abandoned, which is a continuation-in-part application of U.S. patent application Ser. No. 08/261,681, filed Jun. 17, 1994 entitled PACKAGE SLEEVE FOR A STORAGE MEDIA DISC, now abandoned.

FIELD OF THE INVENTION

This invention relates to a label assembly for a package sleeve accommodating a storage media disc and method for sealing a package sleeve. More particularly, in U.S. patent application Ser. No. 08/261,681, filed Jun. 17, 1994, assigned to the common assignee of this application, a package sleeve for accommodating a storage media disc is described which is formed of a relatively inexpensive carton blank. This package sleeve includes a front panel and a back panel connected thereto, and two side flap portions connected to the front panel. The front panel comprises a first folded-over double panel including a front portion and a first outer flap portion and the back panel comprises a second folded-over double panel including a back portion and a second outer flap portion. In order to provide a sleeve cavity for containment of the storage disk media between the first and second folded-over double panels, the side flap portions are adhesively attached to the back panel.

In this prior application, it was contemplated that the package sleeve be covered with shrink wrap to seal the open end of the sleeve cavity. Although shrink wrapping has been found to be an effective means for sealing the sleeve cavity, it has been found that consumers are extremely interested in a sealing mechanism which is easily removable to thereby open the sleeve cavity and remove the disc therefrom.

In the package sleeve of U.S. patent application Ser. No. 08/261,681, the interior surfaces and edges of the package sleeve do not scratch or otherwise damage the disc when it is contained in the sleeve cavity as portions of the first and second folded-over double panels facing the sleeve cavity are treated with a coating to provide scratch resistance. Therefore, in order to keep the disc as clean and scratch resistant as possible, it is also desirable to provide an assembly for sealing the sleeve cavity which will not scratch or place adhesive on the disc.

Further, the package sleeve of U.S. patent application Ser. No. 08/261,681 is readily adaptable to automated assembly processes. In accordance therewith and in order to reduce the labor time necessary to assemble a completed package sleeve, it has been consequently found desirable to provide a label assembly for a package sleeve which is also readily adaptable to automated assembly processes.

It is also contemplated that the package sleeve described in U.S. patent application Ser. No. 08/261,681 will be utilized in direct mailing applications to thereby distribute a single CD-ROM selection to several discrete locations. Therefore, it has further been found desirable to provide a label assembly for sealing the sleeve cavity of the package sleeve which also includes pertinent mailing information for direct mailing applications.

OBJECTS OF THE INVENTION

Accordingly, it is an object of the present invention to provide a label assembly for a package sleeve accommodating a storage media disc and method for sealing a package sleeve.

More specifically, it is an object of the present invention to provide a label assembly for a package sleeve accommodating a storage media disc which reliably seals the open end of the sleeve cavity of the package sleeve and is readily removable to thereby open the sleeve cavity.

It is another object of the present invention to provide a label assembly for a package sleeve accommodating a storage media disc which seals the open end of the sleeve cavity of the package sleeve which will not scratch or place adhesive on the disc.

It is a further object of this invention to provide a label assembly for a package sleeve accommodating a storage media disc which is readily adaptable to automated assembly processes.

It is yet a further object of this invention to provide a label assembly for a package sleeve accommodating a storage media disc which can be utilized in direct mailing applications.

It is a still further object of the present invention to provide a label assembly for a package sleeve accommodating a storage media disc which includes an improved perforation, dual tear strip design.

It is yet a further object of the present invention to provide a label assembly for a package sleeve accommodating a storage media disc which fits snugly over the sleeve cavity of the package sleeve.

It is yet another object of the present invention to provide a label assembly for a package sleeve accommodating a storage media disc which is made of an abrasion resistant material so that the package can go directly through the mail with no additional overwrap required.

It is yet a further object of the present invention to provide a label assembly for a package sleeve accommodating a storage media disc which can be printed with variable information relating to the storage media disc and/or addressing information for direct mail applications such that additional product information and/or mailing labels are not required.

It is still a further object of the present invention to provide a label assembly for a package sleeve accommodating a storage medium disc which permits easy opening of the package by the consumer, but will not open in the mail.

It is yet another object of the present invention to provide a label assembly for a package sleeve accommodating a storage medium disc which creates a visually acceptable package when the sleeve cavity is opened.

It is yet a further object of the present invention to provide a label assembly for a package sleeve accommodating a storage media disc which does not hinder the package sleeve's use as a storage device.

Various other objects, advantages and features of the present invention will become readily apparent from the ensuing detailed description and the novel features will be particularly pointed out in the appended claims.

SUMMARY OF THE INVENTION

According to an aspect of the present invention, a label assembly for a package sleeve including a sleeve cavity for accommodating a storage media disc is provided. This label assembly includes a dual tear strip design which initially covers the sleeve cavity. However, when the dual tear strip is detached along the perforation lines provided in the label assembly, the disc can be removed from the sleeve cavity.

The label assembly of the present invention includes a first information section which has an adhesive backing and is applied to the front portion of the package sleeve, a first tear strip, a second tear strip which covers the sleeve cavity, and a second information section which has an adhesive backing and is applied to the back portion. The first and second tear strips have had their adhesive printed over with a deadening agent so that the tear strips are the same as a tear strip with no adhesive.

The first and second information sections of the label assembly of the present invention are positioned on opposite sides of the dual tear strip assembly with both the first and second information sections having an adhesive backing as aforementioned. In order to utilize the package sleeve in direct mailing applications and thereby distribute a single CD-ROM selection to several discrete locations, the first information section of the label assembly includes mailing identification information such as the mailing address, return address, postal indicia and a postal bar code, etc. The first information section of the label assembly including this mailing identification information is adhesively applied to the front portion of the package sleeve.

The second information section of the label assembly includes product identification information regarding the storage media disc accommodated within the package sleeve. For instance, this product identification information can include text information regarding the disc accommodated in the package sleeve as well as a product identification bar code regarding the particular disc. In addition to the product identification information, an address verification bar code on the second information section referencing the specific mailing identification on the first information section of the label can be provided for use with an address verification system. The second information section of the label assembly is adhesively applied to the back portion of the package sleeve.

When the label assembly is applied to the package sleeve, the first information section of the label assembly is adhesively attached to the front portion of the package sleeve, the first tear strip is located on the front portion of the package sleeve, the second tear strip covers the sleeve cavity, and the second information section is adhesively attached to the back portion of the package sleeve. The dual tear strip design of the present invention includes three perforation lines, namely a first perforation line between the first information section and the first tear strip, a second perforation line between the first and second tear strips, and a third perforation line between the second tear strip and the second information section. The first tear strip includes a pull tab, which when lifted and pulled, removes the first tear strip as it is severed along the first and second perforation lines. The first and second perforation lines use a zipper perforation design which aids the first tear strip to be removed easily and wholly when the pull tab is lifted and pulled along the perforation line. Once the first tear strip is removed, the second tear strip that closes the sleeve opening is now free from the front portion of the package sleeve and is attached to the second information section of the label assembly along the third perforation line. The second tear strip is simply bent back along the third perforation line and then torn free from the second information section along the third perforation line. As a result thereof, the cavity of the package sleeve is opened and the first information section of the label assembly remains attached to the front portion of the package sleeve and the second information section of the label assembly remains attached to the back portion of the package sleeve.

The material used for the label assembly is a vinyl that is pliable yet strong. The material is very scuff and tear resistant, but will follow a tear that starts at a cut and therefore opens easily along a perforation line. The material is also thermal transfer print capable.

Utilization of the three perforation lines, and thus the dual tear strip design, permits the tear strips to be torn parallel along the perforation lines as the tab is lifted and pulled. Moreover, with the first tear strip being completely retained adjacent to the front portion of the sleeve and employing two zipper perforations along the sides thereof, the first tear strip is easily removed in one piece with a single pull. Also, after both the first and second tear strips are removed, no loose or ragged edges remain to visually detract from the package sleeve or hinder its use as a storage device.

The above, and other objects, features and advantages of the present invention will become apparent in the following detailed description of certain preferred embodiments which are to be read in conjunction with the accompanying drawings, and in which like reference numerals are used to identify the same or similar parts in the several views.

BRIEF DESCRIPTION OF THE DRAWINGS

FIG. 1 is a plan view of one side of the blank for forming a package sleeve for containing a storage media disc;

FIG. 2 is a plan view of the other side of the blank of FIG. 1;

FIG. 10 is a front perspective view of the label assembly of FIGS. 9A and B being applied to the finished package sleeve illustrated in FIGS. 7 and 8;

FIG. 11 is a front perspective view of a label roll including a plurality of the label assemblies of FIGS. 9A and B;

FIG. 12 is a front perspective view illustrating the first tear strip being removed from the label assembly applied to the package sleeve;

FIG. 13 is an enlarged view of a portion of FIG. 12 illustrating the pull tab of the first tear strip being lifted and pulled to remove the first tear strip from the label assembly along the first and second perforation lines;

DETAILED DESCRIPTION OF A PREFERRED EMBODIMENT

Figure 3:
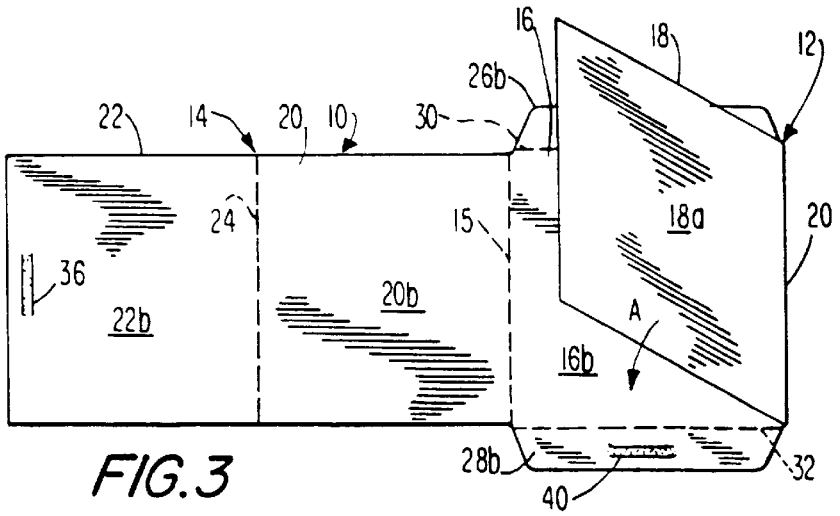
FIGS. 3 through 6 are sequential plan views illustrating the folding of the carton blank of FIGS. 1 and 2 to achieve a package sleeve.

The present invention relates to a label assembly for the package sleeve accommodating a storage media disc, such as the package sleeve described in U.S. patent application Ser. No. 08/261,681, the disclosure of which is specifically incorporated by reference.

Referring now to FIGS. 1 and 2, a carton blank 10 for forming a package sleeve for accommodating storage media discs in accordance with the teachings of U.S. patent application Ser. No. 08/261,681 is illustrated. More specifically, FIG. 1 illustrates one side of the carton blank and FIG. 2 illustrates the opposite side thereof.

As is shown in FIGS. 1 and 2, the blank includes a front panel 12 and a back panel 14 connected to the front panel 12 along fold line 15. The front panel 12 is comprised of a front portion 16 and a first outer flap portion 18 connected to the front portion 16 along bend line 21. The back panel 14 of the blank is comprised of a back portion 20 and a second outer flap portion 22 connected to the back portion 20 along bend line 24. Two side flap portions 26 and 28 are respectively connected to the front portion 16 along bend lines 30 and 32. For purposes of illustration, the features of the front panel 12, back panel 14, front portion 16, outer flap portions 18 and 22, back portion 20 and side flap portions 26 and 28 shown on the side of FIG. 1 have also been designated as 12*a*, 14*a*, 16*a*, 18*a*, 20*a*, 22*a*, 26*a* and 28*a* whereas those features on the other side of FIG. 2 have been designated as 12*b*, 14*b*, 16*b*, 18*b*, 20*b*, 22*b*, 26*b* and 28*b*.

The carton blank 10 disclosed in U.S. patent application Ser. No. 08/261,681 has the following preferred properties:

| | | |
|---|---|---|
| Basis weight, lbs/3,000 Sq. Ft. | | 172 |
| gam | | 279.9 |
| Caliper, .001 inch | | 14.0 |
| mm | | 0.356 |
| Stiffness, Taber | MD | 132 |
| | CD | 65 |
| mNm | MD | 12.95 |
| | CD | 6.38 |
| Brightness, % | CS | 83 0 |
| | UCS | 82 5 |
| Moisture, % | | 5.8 |
| Gloss, % | CS | 57 |
| Smoothness | CS | 29 |
| (Sheffield Units) | UCS | 185 |

Such a carton material with the above properties is currently available from International Paper Corporation, Bleached Board Division having the Grade Code 1220, under the tradename Everest which can be described as 14 pnt, SBS, C1S, 0.014", solid bleached sulfite, coated one side.

Figure 4:
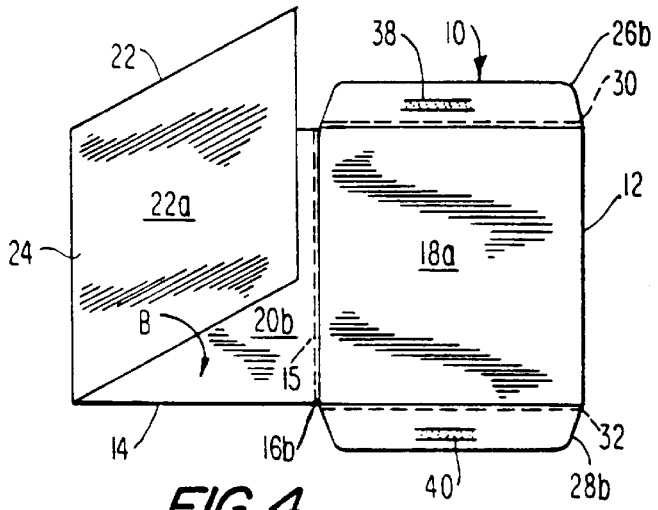
Figure 5:
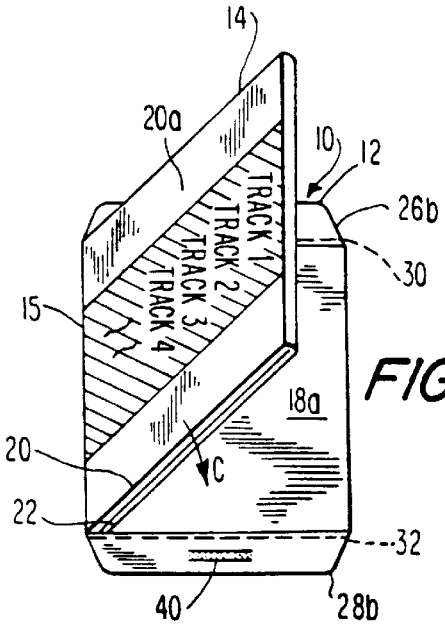

The process for making the package sleeve of U.S. patent application Ser. No. 08/261,681 is illustrated in FIGS. 3 through 6. Initially, the first outer flap portion 18 is folded along fold line 20 in the direction of arrow A as shown in FIG. 3 such that the glue area 34 provided on the side 18*b* of outer flap portion 18 is adhesively attached to the side 16*b* of front portion 16. Next, as is illustrated in FIG. 4, the second outer flap portion 22 is folded along fold line 24 in the direction of arrow B such that the glue area 36 provided on the side 22*b* of outer flap portion 22 is adhesively attached to the side 20*b* of back portion 20. The back portion 20 with the outer flap portion 22 adhered thereto are then folded along fold line 15 in the direction of arrow C (see FIG. 5) such that the outer flap portion 22 is aligned with the outer flap portion 18. Subsequent thereto, the two side flap portions 26 and 28 are respectively folded along fold lines 30 and 32 in the direction of arrows D and E in FIG. 6 such that the glue areas 38 and 40 provided on the respective sides 26*b* and 28*b* of the flap portions are adhesively attached to the back portion 20. As a result thereof, a sleeve cavity 42 is formed between outer flap portions 18 and 22 for containment of a storage media disc therein. The entire folded blank is then pressed flat. Although not required due to the design of the label assembly of the present invention, the package sleeve can be covered with shrink wrap to seal the open end of the sleeve cavity 42.

Figure 6:
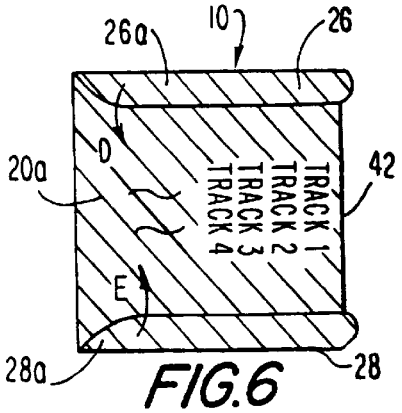
Figure 7:
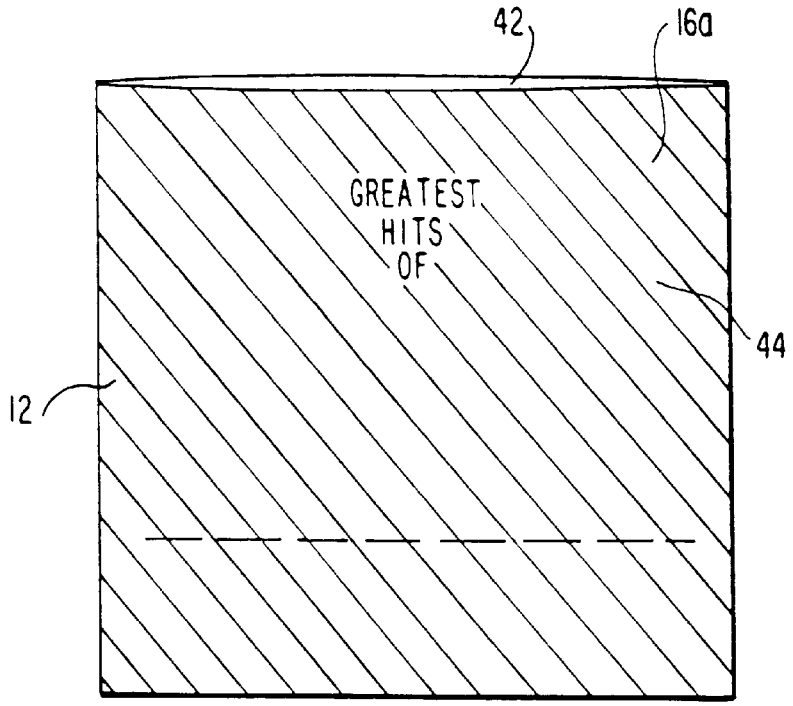
FIG. 7 is a front elevational view of a completed package sleeve made in accordance with the sequential views of FIGS. 3 through 6.
Figure 8:
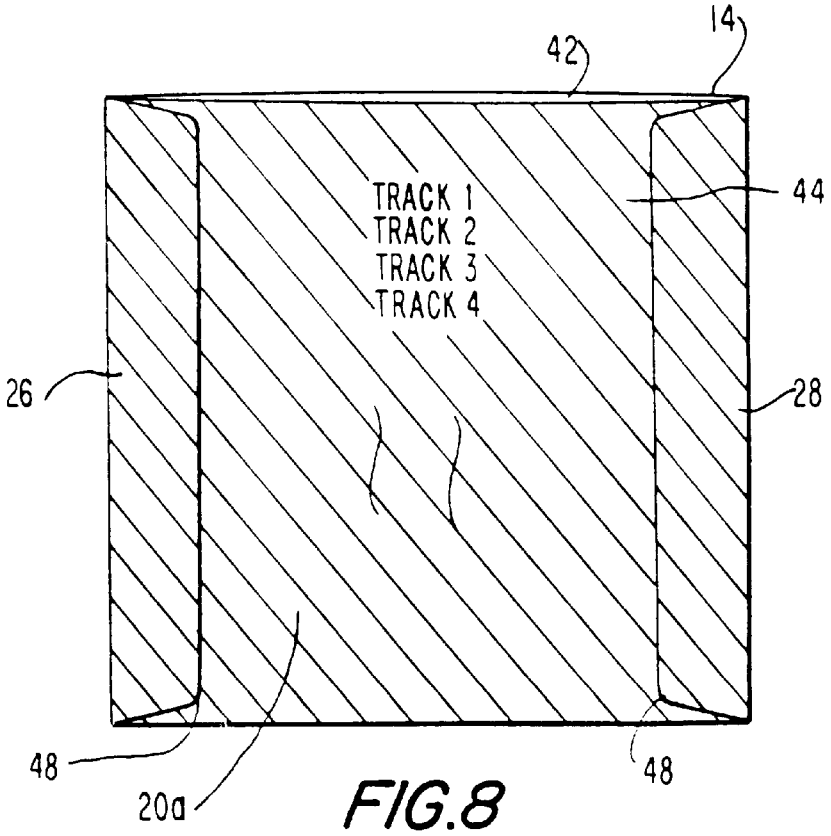
FIG. 8 is a rear elevational view of the package sleeve of FIG. 7.

As is best shown in FIGS. 7 and 8, a package sleeve for accommodating storage media disk is therefore provided having a front panel 12 and a back panel 14 connected thereto along fold line 15 with the two side flap panels 26 and 28 connected to the front panel 12. The front panel 12 is in the form of a first folded-over double panel including the outer flap portion 18 and the front portion 16 and the back panel 14 is in the form of a second folded-over double panel including the outer flap portion 22 and the back portion 20. As is shown in FIGS. 6 and 8, the two side flap portions 26 and 28 are adhesively attached to the back panel 14 to form the sleeve cavity 42 between the outer flap portion sides 18*a* and 22*a* for containment of the storage disc media therein.

As is shown in the figures, the side flap portions 26 and 28 have generally rounded corners, such as 46 and 48 (see FIG. 8). This corner design retards wear of the side flap portions which would be enhanced if sharp corners were present. These rounded corners also provide a generally cleaner appearance to the finished package sleeve.

The carton blank 10 of FIGS. 1 and 2 has also been specifically designed to accommodate a storage media disc (i.e., compact or ROM compact disc) having a diameter no greater than 12 cm. As designed, the overall blank 10 has a dimension of approximately 19¾" in length and 6⅝" in width. The front portion 16 has a dimension of approximately 5" in length and 5⅛" in width whereas the back portion 20 has a dimension of approximately 5" in length and 4¹⁵⁄₁₆" in width. The outer flap portions 18 and 22 both have dimensions of approximately 4⅞" in length and 4¹⁵⁄₁₆" in width. The fold lines are preferably ¹⁄₁₆" wide. Moreover, in order to provide product consistency, the paper stock grain direction of the blank is along the length thereof.

These internal dimensions of the sleeve assist in keeping the disc trapped after insertion. This package sleeve can be turned open side down and shaken without the disc becoming dislodged. The only way to remove the disc from the sleeve is to apply light pressure to the sides of the sleeve in order to make the sleeve cavity "pucker." Without this external pressure on the sleeve the disc remains gently held in place by the extreme outer edge non-program area of the disc.

The package sleeve of U.S. patent application Ser. No. 08/261,681 also has printed areas 44 on one side of the front portion 16, back portion 20 and side flap portion 26 and 28 of the blank 10 (See FIG. 1) to provide printed information, such as information about the musical recordings, the artists and other such promotional materials, for the CD or ROM compact disc contained within the package sleeve. After the folding process, the printed areas 44 appear on the exterior surface of the package sleeve (see FIGS. 7 and 8) for visual display to the purchaser.

The side of the package sleeve containing the printed area (i.e., the side of the carton blank 10 shown in FIG. 1) is treated with a coating to provide scratch resistance for the storage media disc. This coating is preferably an aqueous-based acrylic clear coating. One such representative aqueous-based acrylic clear coating is manufactured by Algan, Inc. under the trade designation Algloss Overcoating 3048. This coating typically has the following physical properties:

Viscosity: 30–35 seconds, #3 Zahn cup @ 70° F.
pH: 8.0–9.0
Non-Volatiles: 40–42%
VOC: 1.4 lbs/gallon minus water
Weight/Gallon: 8.5–8.7 lbs
Freeze/Thaw Stability: One cycle By treating the side of FIG. 1 of the carton blank with such a coating, the outer flap portion sides 18*a* and 22*a* which face into the sleeve cavity 42 in the finished package sleeve (see FIGS. 7 and 8) will be so coated. Thus, the interior surfaces and edges of this package sleeve will not scratch or otherwise damage the audio or ROM compact disc when it is contained in the sleeve cavity 42.

As described below, the present invention relates to a label assembly for a package sleeve accommodating a storage media disc, such as the package sleeve of FIGS. 1 through 8 of this application which is described in U.S. patent application Ser. No. 08/261,681. The label assembly of the present invention is illustrated in FIGS. 9A–D, 10–13, 14A–B, and 15A–B of this application.

Figure 9A:
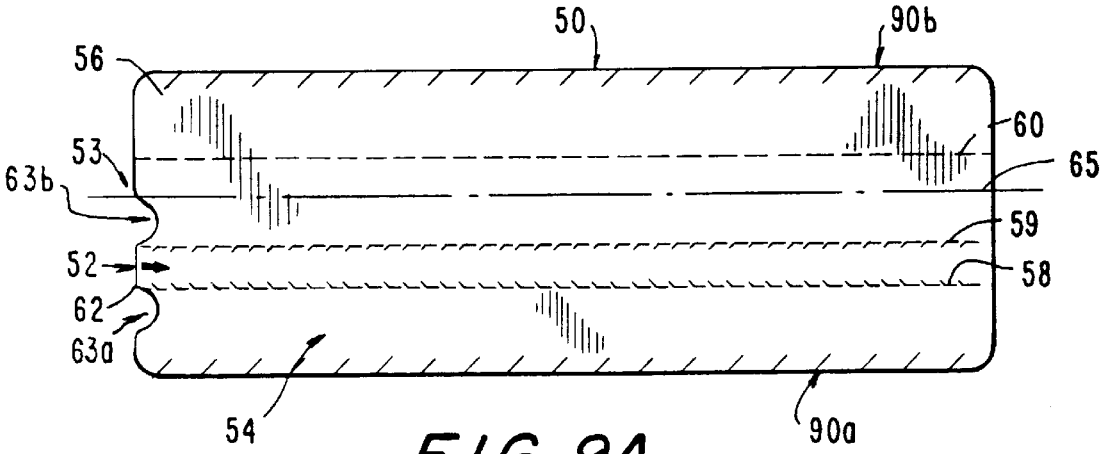
FIG. 9A is a plan view of a preferred embodiment of a label assembly in accordance with the teachings of the present invention.
Figure 9B:
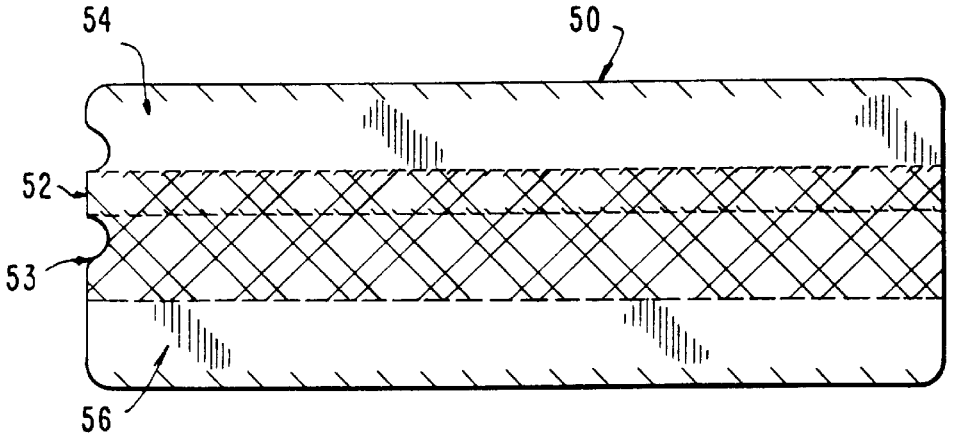
FIG. 9B is a plan view of the other side of the label assembly of FIG. 9A.

Referring now to the preferred embodiment of FIG. 9A and 9B, the label assembly 50 of the present invention has an overall dimension of approximately 4⅞" in width and 1¾" in length and includes four sections: namely, a first tear strip 52 (approximately ¼"×4⅞"), a second tear strip 53 (approximately ½"×4⅞") and respective first and second information sections 54 and 56 provided as adjacent face end sections detachable joined respectively to the first and second tear strips 52 and 53. In order for the label assembly to be applied to a package sleeve, the first and second information sections 54 and 56 have an adhesive backing. The first and second tear strips 52 and 53 have had their adhesive painted over with a deadening agent so that the tear strips 52 and 53 are the same as a first and second tear strip with no adhesive (see hatched area in FIG. 9B). As is shown in FIG. 10, when applied to the package sleeve 10, the second tear strip 53 covers the sleeve cavity 42 so that storage media disc accommodated within the sleeve cavity will be sealed therein until ready for use. Alternatively, the first information section 54*b* can be lengthened as shown in the label assembly of FIGS. 9C and 9D for the inclusion of additional mailing information.

The dual tear strip design of the present invention includes three perforation lines; namely: a first perforation line 58 provided between the first information section 54 and the first tear strip 52, a second perforation line 59 provided between the first and second tear strips 52 and 53, and a third perforation line 60 provided between the second tear strip 53 and the second information section 56. When it is desirable to remove the disc from the sleeve cavity 42, a pull tab 62 provided on the first tear strip 52 is lifted and pulled, as will be described in more detail below, to detach the first tear strip 52 along first and second perforation lines 58 and 59.

More specifically, perforation lines 58 and 59 are in the form of zipper perforations to facilitate easy opening thereof. Additionally, in order to easily pull the pull tab 62, the first information section 54 and the second tear strip 53 have respective generally concave recesses 63*a* and 63*b* of approximately ⅛" radius adjacent to the pull tab 62. Accordingly, the pull tab 62 extends outwardly from the adjacent regions of the first information section 54 and the second tear strip 53 to facilitate ease of the consumer in grasping and pulling the pull tab 62 of the first tear strip 52. Both perforation lines 58 and 59 begin with a cut at the pull tab end 62 of tear strip 52 and end with ties at the end of tear strip 52 opposite pull tab 62. The first and second tear strips 52 and 53 include a deadened adhesive backing to keep the first tear strip 52 from sticking to the package sleeve 10.

In accordance with one of the general objects of the present invention, the second tear strip 53 of the label assembly 50 of the present invention not only seals the open end of the sleeve cavity 42 but is also designed such that it will not scratch or place adhesive on the disc. In accordance therewith, as aforementioned, the second tear strip 53 includes a deadened adhesive portion backing covering and facing the open end of the sleeve cavity to assure that no adhesive can contact the disc.

The width of the second tear strip 53 is preferably approximately 0.5" so that this label assembly cannot only be used with a package sleeve accommodating a single storage media disc but also be used with package sleeves accommodating double, triple, quad, etc. storage media discs. This label assembly could then be utilized to close multiple single disc package sleeves that are glued together.

Figure 9C:
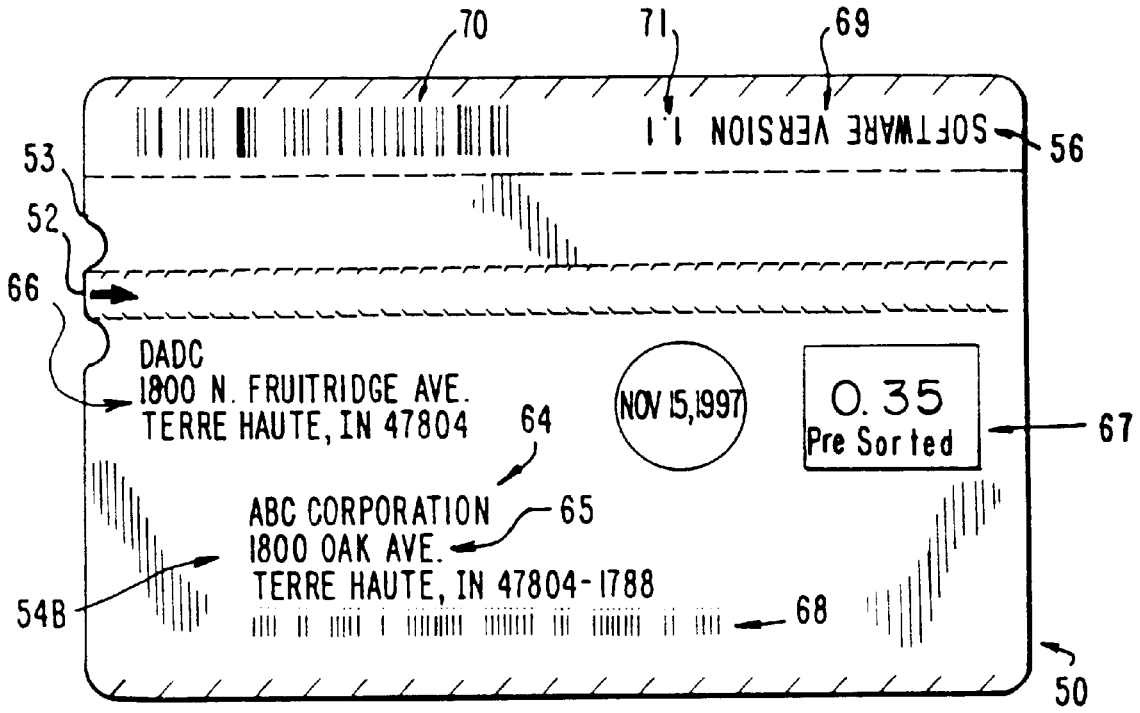
FIG. 9C is a plan view of another preferred embodiment of a label assembly in accordance with the teachings of the present invention with an extended first information section to provide enhanced space for the inclusion of mailing information.
Figure 9D:
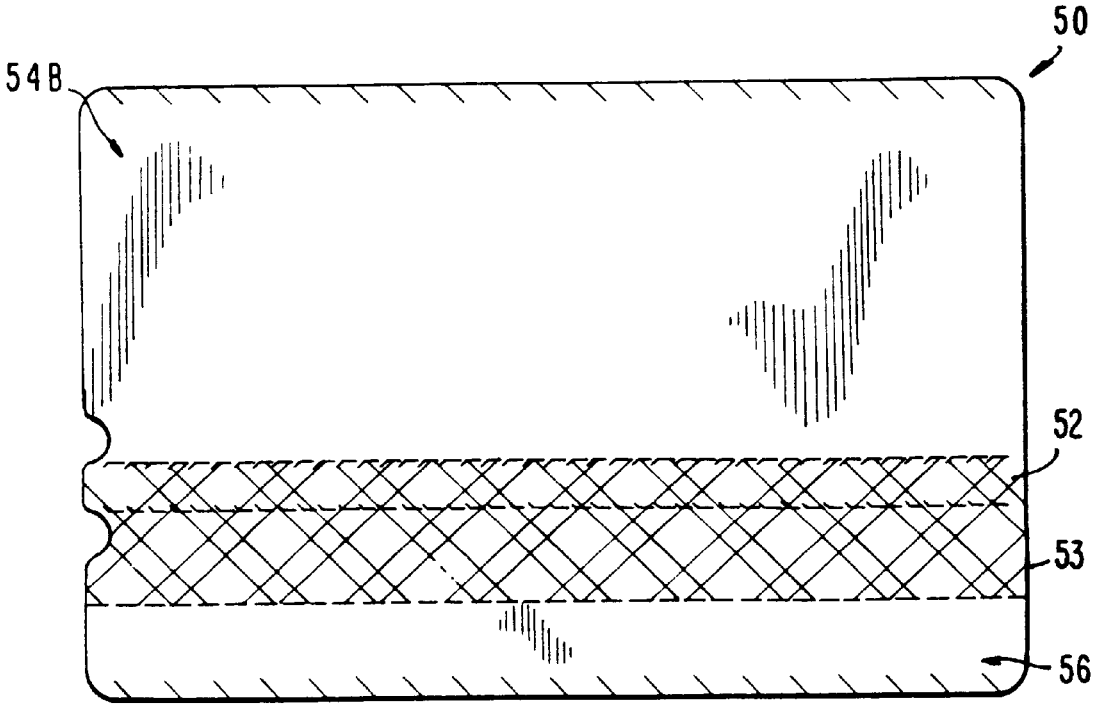
FIG. 9D is a plan view of the other side of the label assembly of FIG. 9C.
Figure 14A:
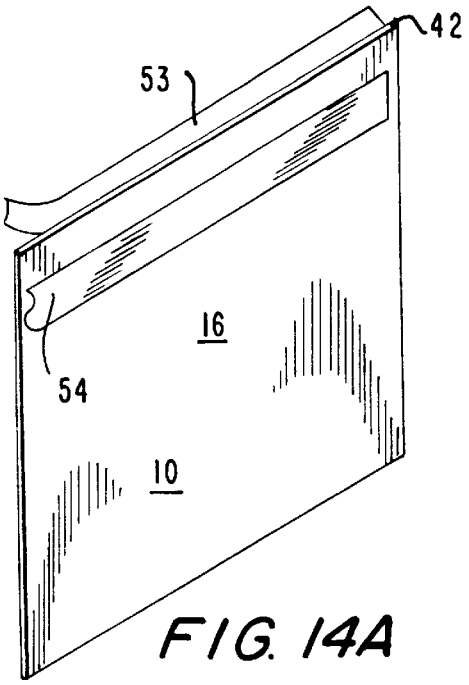
FIG. 14A is a front perspective view illustrating the second tear strip being removed from the label assembly of FIG. 9A along a third perforation line to completely open the sleeve cavity of the package sleeve.
Figure 15A:
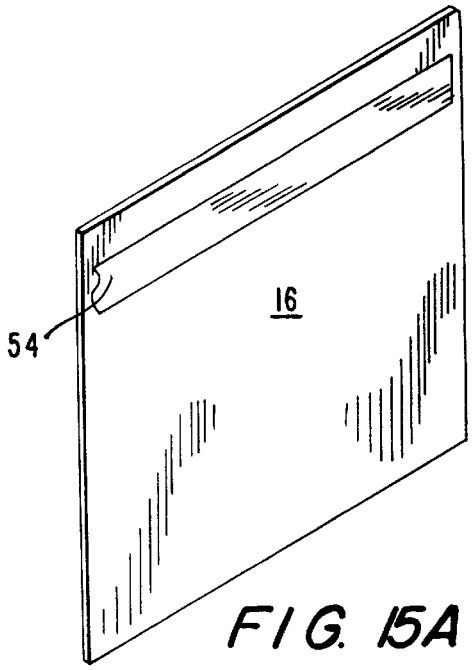
FIG. 15A is a front perspective view illustrating the first and second tear strips being completely removed from the label assembly of FIG. 9A with the first and second information sections remaining adhesively applied to the front and back portions of the package sleeve.
Figure 14B:
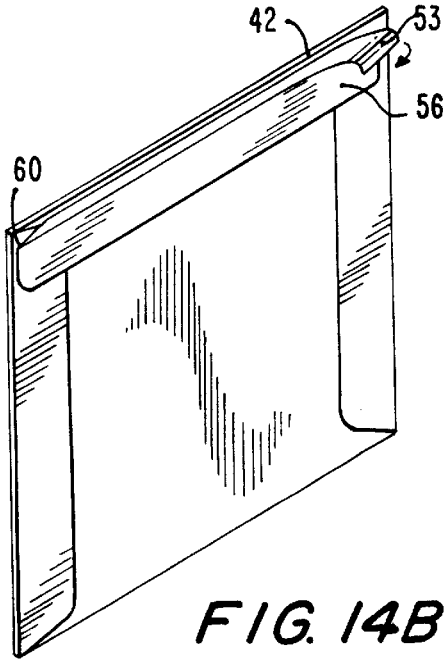
FIG. 14B shows the back side of the package sleeve of FIG. 14A with the label assembly of FIG. 9A applied thereto.
Figure 15B:
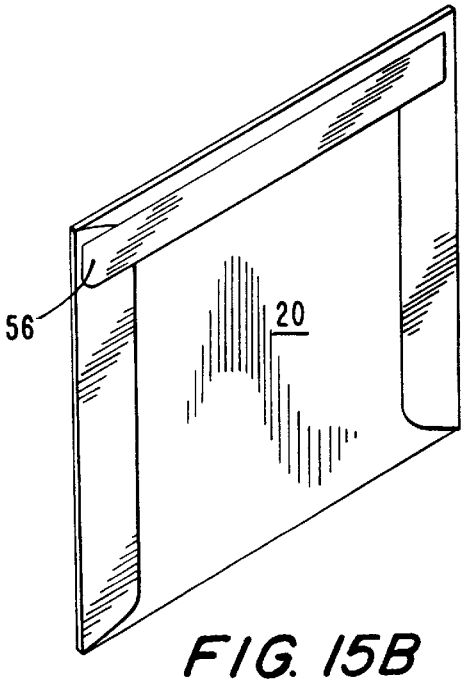
FIG. 15B shows the back side of the package sleeve in FIG. 15 with the label assembly of FIG. 9A (with the first and second tear strips removed) applied thereto.

In order to distribute a single title within the package sleeve to multiple address locations, the first information section 54 of the label assembly 50 can be extended as shown in FIGS. 9C and 9D. The first information section in this configuration, generally designated as 54B, includes identifying mailing information 64 printed thereon for shipping. This identifying mailing information 64 can include information such as the mailing address 65 of the recipient of the package sleeve, the return address of the sender 66, postal indicia 67 and a postal bar code 68.

As illustrated in FIG. 9C, the second information section 56 includes product identification information 69 regarding the particular disc accommodated within the package sleeve or a product identification bar code regarding the disc. In addition, an address verification bar code 70 can be included on the second face 56 which references the specific mailing information 64 on the first information section 54B of label assembly 50 which is to be used by an address verification system.

More specifically, an Address Identification Bar Code is a simple numeric bar code that is used in conjunction with an Address Labeling and Verification System, or ALAVS, to make a loop verification that a mailing list has indeed been consummated. When a mailing list is received, a unique number is attached to each address. This number is then added in bar code form to the respective mailing label. This unique bar coded number is added to the appropriate section of the label assembly of the present invention. This bar code is then read into a file at the ALAVS where it is cross-referenced with the original mailing list to verify that every address received was fulfilled. Any discrepancies are reported at the end of a production run so that they can be corrected. As a result, a verification report is printed confirming that each address was applied to a closed sleeve and the package did contain the correct selection.

Therefore, in one preferred embodiment, this product identification information 69 can include text information 71, including possibly a software title or revision number, regarding the disc accommodated within the package sleeve and a product identification bar code (not shown) regarding the disc. As a result thereof, and in summary, this product identification information assists in tracking the disc in inventory as well as providing additional consumer information regarding the disc.

Advantageously, the label material is vinyl for strength (preferably, Walace #401 Kimdura synthetic vinyl), glossy white for appearance and has a permanent adhesive for security. This vinyl material is pliable yet strong. The material is very scuff and tear resistant; but will follow a tear that starts at a cut and therefore opens easily along a perforation line.

The label material is also thermal transfer print compatible. Thus, the identifying mailing information 64 and product identification information 69 can be printed onto the label assembly before the label assembly is applied to the package sleeve.

As is shown in FIG. 10, the present invention also relates to a method for sealing a package sleeve, such as the package sleeve described and illustrated in U.S. patent application Ser. No. 08/261,681. When the label assembly 50 is applied to the package sleeve 10, the first information section 54 of the label assembly is adhesively attached to the front portion 16 of the package sleeve, and the second information section 56 is adhesively attached to the back portion 20 of the package sleeve. The second tear strip 53 covers the sleeve cavity 42 with the deadened adhesive backing of the second tear strip 53 facing the sleeve cavity so that no adhesive can contact the disc accommodated within the sleeve cavity. The second tear strip 53 is generally folded over the sleeve cavity 42 along center fold line 65 (see FIG. 9).

When it is desired to remove the storage media disc from the sleeve cavity 42, the pull tab 62 of the first tear strip 52 is lifted upwardly and pulled such that the first tear strip 52 is detached along first and second perforation lines 58 and 59 (see FIGS. 12 and 13). Once the front tear strip 52 is removed, the second tear strip 53 that closes the sleeve cavity 42 is now free from the front portion 16 of the package sleeve but remains attached to the second information section 56 of the label assembly along the third perforation line 60 (see FIG. 14). The second tear strip 53 is simply bent back along the third perforation line 60 and then torn free from the second information section 56 along the third perforation line 60. As a result thereof, the sleeve cavity 42 of the package sleeve is opened to remove the disc and the first information section 54 of the label assembly remains adhesively attached to the front portion 16 of the package sleeve and the second information section 56 of the label assembly remains adhesively attached to the back portion 20 of the package sleeve (see FIGS. 15A & 15B). Therefore, when adhesively applied, the mailing identification information 64 and the product identification information 66 of the first and second information sections 54 and 56 are exposed and therefore the information contained thereon can be visually read and/or scanned with a bar code reader.

Moreover, after the first and second tear strips 52 and 53 are removed, the first information section 54 is positioned ½" down from the top of the first portion 16 of the package sleeve due to the additional width of the first tear strip 52 and the second information section 56 is positioned ¼" down from the top of the back portion 20. Using a ½" flap of the second tear strip 53 to cover the sleeve positions the perforations 58, 59, and 60 sufficiently away from the top of the sleeve where they may interfere with the sleeve's storage function. This also allows the label to be snugly wrapped over the sleeve opening without fear of the perforations being too close to a corner of the sleeve where they may start to open on their own if handled roughly as may occur during postal handling.

As is shown in FIG. 11, the label assembly 50 of the present invention is also advantageous for automated assembly processes as the individual labels, such as 50*a* and 50*b*, can be fed at high speed off of a roll of labels 80 to be secured to each package sleeve 10 (see FIG. 11).

As is shown in FIGS. 9A–D and 10, the label assembly of the present invention also includes a tamper resistant feature. More particularly, the first and second information sections 54 and 56 include respective small nicks, such as 90*a* and 90*b*, along the free edges thereof. As a result, if an attempt is made to lift the entire label without opening by means of the tear strips 52 and 53, the label would destroy itself by initiating a tear from these nick points. Accordingly, the label would not be able to be replaced after opening by this means. Therefore, the tampering would be evident.

By using the three perforation lines and thus the dual tear strip design of the label assembly of the present invention, the tear strips are allowed to be torn parallel along the perforation lines as the pull tab 62 is lifted and pulled. In addition, with the first tear strip 52 being completely retained on the front portion 16 of the sleeve and employing two perforations along the sides thereof, the first tear strip 52 is easily removed in one piece with a single pull. Also, after both the first and second tear strips 52 and 53 are removed, no loose or rugged edges remain to visually detract from the package sleeve or hinder its use as a storage device (see FIGS. 12 and 13).

Based upon the foregoing, the label assembly of the present invention when applied to a package sleeve forms a secure package by which a single CD-ROM can be mailed. Upon receipt, the pull tab is lifted and the deadened tear strips 52 and 53 are removed to open the sleeve. The disc accommodated in the sleeve cavity can then be removed without damage. The label assembly is further designed so that all necessary mailing information is printed on the label before it is automatically applied. As a result, the label assembly of the present invention is a cost effective means to distribute a single title to multiple address locations. In addition, the combination package sleeve/label assembly is economical to mail due to its reduced size and weight.

As a result of its design, the label assembly of the present invention fits snugly over the sleeve cavity 42. In addition, the label assembly is made of an abrasion resistant material so that the package can go directly through the mail with no additional overwrap required. Further, the label assembly permits the package sleeve to be easily opened by the consumer but does not open in the mail. Moreover, the label assembly is visually acceptable after being opened, i.e. free from ragged edges, and it does not hinder the package sleeve's use as a storage device.

While the present invention has been shown and described with reference to certain preferred embodiments, it will be readily apparent to those of ordinary skill in the art that various changes and modifications may be made therein without departing from the spirit and scope of the invention.

It is intended that the appended claims be interpreted as including the foregoing as well as various other changes and modifications.

What is claimed is:

1. A label assembly for a package sleeve including a sleeve cavity accommodating a storage media disc; said label assembly including a removable tear strip assembly having a pair of removable tear strips with one of said tear strips covering the sleeve cavity such that when detached, the disc can be removed from the sleeve cavity, said tear strips having a deadened adhesive backing so that no adhesive can contact the disc.

2. The label assembly of claim 1 wherein said removable tear strip assembly includes three perforation lines to remove the pair of tear strips to thereby expose the sleeve cavity for removal of the storage media disc.

3. The label assembly of claim 1 which is made of a vinyl material which is thermal transfer print compatible.

4. The label assembly of claim 1 wherein said pair of removable tear strips include a first tear strip and a second tear strip.

5. The label assembly of claim 4 wherein said first and second tear strips include the deadened adhesive backing so as not to stick to the package sleeve or contaminate the storage media disc.

6. The label assembly of claim 4 and further comprising a first information section including mailing identification means for identifying mailing information regarding the package sleeve and a second information section including disc identification means for providing product identifying information regarding the storage media disc accommodated within the package sleeve wherein both said first and second information sections include an adhesive backing.

7. The label assembly of claim 6 wherein said first information section is detachably joined to said first tear strip along a first perforation line, said first and second tear strips are detachably joined along a second perforation line, and said second tear strip and said second information section are detachably joined along a third perforation line.

8. The label assembly of claim 7 wherein said first tear strip has a pull tab which when lifted and pulled removes said first tear strip from said first information section and said second tear strip as said first tear strip is severed therefrom along said first and second perforation lines.

9. The label assembly of claim 8 wherein both said first information section and said second tear strip include generally concave recesses adjacent to said pull tab to assist the user in easily lifting and pulling said pull tab.

10. The label assembly of claim 8 wherein after said first tear strip is removed, said second tear strip when pulled can be removed from said second information section along said third perforation thereby permitting removal of the storage media disc through the opening of the package sleeve.

11. The label assembly of claim 10 wherein when said first and second tear strips are removed from the label assembly along said first, second and third perforation lines, said first information section remains adhesively attached to a front portion of the package sleeve and the second information section remains adhesively attached to a back portion of the package sleeve.

12. The label assembly of claim 7 wherein said first and second perforation lines are in the form of zipper perforations.

13. The label assembly of claim 6 wherein said mailing identification means includes mailing identification information selected from the group consisting of a mailing address, a return address, postal indicia and means for encoding postal information.

14. The label assembly of claim 6 wherein said disc information means includes disc identification information selected from the group consisting of text information regarding the disc and means for encoding disc information.

15. The label assembly of claim 1 and further including means for indicating tampering of the label assembly.

16. The label assembly of claim 15 wherein said tamper indicating means includes a plurality of small nicks being provided along free edges of said first and second information sections wherein if the entire label assembly is attempted to be removed, a tear is initiated from said nicks to evidence tampering of the package sleeve.

17. A package sleeve/label assembly comprising:

a package sleeve including a sleeve cavity for accommodating a storage media disc therein and having a front portion and a back portion;

a label assembly including a removable tear strip assembly having a pair of removable tear strips with one of said tear strips covering the sleeve cavity such that when detached, the disc can be removed from the sleeve cavity, said tear strips having a deadened adhesive backing so that no adhesive can contact the disc; said label assembly further including a first information section and a second information section each being detachably joined to one of said pair of tear strips and each having a free end; and wherein each said first and second information sections have an adhesive backing such that said label assembly can be adhesively attached to said package sleeve; said first information section including mailing identification means for identifying mailing information regarding the package sleeve and said second information section including disc identification means for providing product identification information regarding the storage media disc accommodated within the package sleeve.

18. The package sleeve/label assembly of claim 17 wherein said removable tear strip assembly includes three perforation lines to remove the pair of tear strips to thereby expose the sleeve cavity for removal of the storage media disc.

19. The package sleeve/label assembly of claim 17 which is made of a vinyl material which is thermal transfer print compatible.

20. The package sleeve/label assembly of claim 17 wherein said pair of removable tear strips include a first tear strip and a second tear strip.

21. The package sleeve/label assembly of claim 20 wherein said first and second tear strips include a deadened adhesive backing so as not to stick to the package sleeve or contaminate the storage media disc.

22. The package sleeve/label assembly of claim 20 wherein said first information section is detachably joined to said first tear strip along a first perforation line, said first and second tear strips are detachably joined along a second perforation line, and said second tear strip and said second information section are detachably joined along a third perforation lines.

23. The package sleeve/label assembly of claim 22 wherein said first and second perforation lines are in the form of zipper perforations.

24. The package sleeve/label assembly of claim 22 wherein said first tear strip has a pull tab which when lifted and pulled removes said first tear strip from said first information section and said second tear strip as said first tear strip is severed therefrom along said first and second perforation line.

25. The package sleeve/label assembly of claim 24 wherein both said first information section and said second tear strip include generally concave recesses adjacent to said pull tab to assist the user in easily lifting and pulling said pull tab.

26. The package sleeve/label assembly of claim 24 wherein after said first tear strip is removed, said second tear strip when pulled can be removed from said second information section along said third perforation thereby permitting removal of the storage media disc through the opening of the package sleeve.

27. The package sleeve/label assembly of claim 26 wherein when said first and second tear strips are removed from the label assembly along said first, second and third perforation lines, said first information section remains adhesively attached to a front portion of the package sleeve and the second information section remains adhesively attached to a back portion of the package sleeve.

28. The package sleeve/label assembly of claim 17 wherein said mailing identification means includes mailing identification information selected from the group consisting of a mailing address, a return address, postal indicia and means for encoding postal information.

29. The package sleeve/label assembly of claim 17 wherein said disc information means includes disc identification information selected from the group consisting of text information regarding the disc and means for encoding disc information.

30. The package sleeve/label assembly of claim 17 and further including means for indicating tampering of the label assembly.

31. The package sleeve/label assembly of claim 30 wherein said tamper indicating means includes a plurality of small nicks being provided along free edges of said first and second information sections wherein if the entire label assembly is attempted to be removed, a tear is initiated from said nicks to evidence tampering of the package sleeve.

32. A combination storage media disc container/seal identification assembly comprising:

a package sleeve for accommodating a storage media disc therein comprising a front panel and back panel connected thereto, and two side flap portions connected to said front panel, said front panel comprises a first folded-over double panel and said back panel comprises a second folded-over double panel and said side flap portions are adhesively attached to said back panel to form a sleeve cavity between said first and second folded-over double panels for containment of the storage media disc therein;

a label assembly including a removable tear strip assembly having a pair of removable tear strips with one of the tear strips covering the sleeve cavity such that when detached, the disc can be removed from the sleeve cavity, said tear strips having a deadened adhesive backing so that no adhesive can contact the disc; said label assembly further including a first information section and a second information section each being detachably joined to one of said pair of tear strips and each having a free end and wherein each said first and second information sections have an adhesive backing such that said label assembly can be adhesively attached to said package sleeve; said first information section including mailing identification means for identifying mailing information regarding the package sleeve and said second information section including disc identification means for providing product identification information regarding the storage media disc accommodated within the package sleeve.

33. The combination storage media disc container/seal identification assembly of claim 32 wherein said removable tear strip assembly includes three perforation lines to remove the pair of tear strips to thereby expose the sleeve cavity for removal of the storage media disc.

34. The combination storage media disc container/seal identification assembly of claim 32 which is made of a vinyl material which is thermal transfer print compatible.

35. The combination storage media disc container/seal identification assembly of claim 32 wherein said pair of removable tear strips includes a first tear strip and a second tear strip.

36. The combination storage media disc container/seal identification assembly of claim 35 wherein said first and second tear strips include a deadened adhesive backing so as not to stick to the package sleeve or contaminate the storage media disc.

37. The combination storage media disc container/seal identification assembly of claim 35 wherein said first information section is detachably joined to said first tear strip along a first perforation line, said first and second tear strips are detachably joined along a second perforation line, and said second tear strip and said second information section are detachably joined along a third perforation line.

38. The combination storage media disc container/seal identification assembly of claim 37 wherein said first and second perforation lines are in the form of zipper perforations.

39. The combination storage media disc container/seal identification assembly of claim 37 wherein said first tear strip has a pull tab which when lifted and pulled removes said first tear strip from said first information section and said second tear strip as said first tear strip is severed therefrom along said first and second perforation lines.

40. The combination storage media disc container/seal identification assembly of claim 39 wherein both said first information section and said second tear strip includes generally concave recesses adjacent to said pull tab to assist the user in easily lifting and pulling said pull tab.

41. The combination storage media disc container/seal identification assembly of claim 39 wherein after said first tear strip is removed, said second tear strip when pulled can be removed from said second information section along said third perforation line thereby permitting removal of the storage media disc through the sleeve cavity of the package sleeve.

42. The combination storage media disc container/seal identification assembly of claim 41 wherein when said first and second tear strips are removed from the label assembly along said first, second and third perforation lines, said first information section remains adhesively attached to a front portion of the package sleeve and the second information section remains adhesively attached to a back portion of the package sleeve.

43. The combination storage media disc container/seal identification assembly of claim 32 wherein said mailing identification means includes mailing identification information selected from the group consisting of a mailing address, a return address, postal indicia, and means for encoding information.

44. The combination storage media disc container/seal identification assembly of claim 32 wherein said disc information means includes disc identification information selected from the group consisting of text information regarding the disc and means for encoding disc information.

45. The combination storage media disc container/seal identification assembly of claim 32 and further including means for indicating tampering of the label assembly.

46. The combination storage media disc container/seal identification assembly of claim 45 wherein said tamper indicating means includes a plurality of small nicks being provided along free edges of said first and second information sections wherein if the entire label assembly is attempted to be removed, a tear is initiated from said nicks to evidence tampering of the package sleeve.

47. A method for sealing a package sleeve having a front portion and a rear portion and which accommodates information media within a sleeve cavity provided between the front and rear portions and for removing the information media from the sleeve cavity, said method comprising the steps of adhesively attaching first and second information sections of a label assembly to the respective front and back portions of the package sleeve such that a removable tear strip assembly of the label assembly seals the sleeve cavity of the package sleeve, wherein said first information section includes mailing identification information for the package sleeve and said second information section includes disc identification information regarding the information media contained within the package sleeve, and wherein said removable tear strip assembly includes first and second tear strips with said first tear strip being detachably joined to said first information section and said second tear strip along respective first and second perforation lines and said second tear strip is detachably joined to said second information second along a third perforation strip;

removing said first tear strip from said label assembly by lifting and pulling a pull tab of said first tear strip to separate said first tear strip from said first information section and second tear strip along said first and second perforation lines to thereby expose a free end of said second tear strip; and removing said second tear strip from said second information section along said third perforation line to permit removal of the information media through the opening of the sleeve cavity and permit continued adhesive attachment of only said first and second information sections of the label assembly respectively to the front and back portions of the package sleeve.

* * * * *